US010982847B2

(12) United States Patent
Tsai

(10) Patent No.: US 10,982,847 B2
(45) Date of Patent: Apr. 20, 2021

(54) GAS COMBUSTOR WITH FUNCTION OF ADJUSTING COMBUSTION ANGLE

(71) Applicant: ROBURN COMPANY LTD., New Taipei (TW)

(72) Inventor: Chin-Lin Tsai, New Taipei (TW)

(73) Assignee: ROBURN COMPANY LTD., New Taipei (TW)

( * ) Notice: Subject to any disclaimer, the term of this patent is extended or adjusted under 35 U.S.C. 154(b) by 52 days.

(21) Appl. No.: 16/449,417

(22) Filed: Jun. 23, 2019

(65) Prior Publication Data

US 2020/0149740 A1 May 14, 2020

(30) Foreign Application Priority Data

Nov. 14, 2018 (TW) ..... 107215461

(51) Int. Cl.
*F23D 14/38* (2006.01)
*F23D 14/52* (2006.01)

(52) U.S. Cl.
CPC ..... *F23D 14/38* (2013.01); *F23D 14/52* (2013.01)

(58) Field of Classification Search
CPC ..... F23D 14/38; F23D 14/00
USPC ..... 126/401–414; 403/93; 431/344–345, 431/355, 132
See application file for complete search history.

(56) References Cited

U.S. PATENT DOCUMENTS 5,466,149 A 11/1995 Tsai et al.
5,564,919 A 10/1996 Tsai et al.
5,667,377 A * 9/1997 Lin ..... F23D 14/28 126/406
5,735,684 A 4/1998 Tsai et al.
5,816,794 A 10/1998 Tsai et al.
2006/0281039 A1* 12/2006 Luo ..... F23Q 2/287 431/255
2018/0066842 A1 3/2018 Tsai

* cited by examiner

*Primary Examiner* — Vivek K Shirsat
(74) *Attorney, Agent, or Firm* — Guice Patents PLLC

(57) ABSTRACT

A gas combustor with function of adjusting combustion angle includes: a handgrip part; a fastening rack, disposed at a top end of the handgrip part, and having at least one positioning disk having an outer circumference annularly disposed with plural positioning slots; and a flame device, wherein one end of flame device has a pivotal part pivoted with the at least one positioning disk, and correspondingly disposed with an elastic buckle mechanism capable of being buckled in each positioning slot at a location corresponding to the at least one positioning disk; with each elastic buckle mechanism being displaced along the outer circumference of the corresponding at least one positioning disk, and buckled in one of the positioning slots according to a desired inclined angle, the flame device is provided with a combustion angle adjusting effect relative to the handgrip part.

14 Claims, 10 Drawing Sheets

B-B

GAS COMBUSTOR WITH FUNCTION OF ADJUSTING COMBUSTION ANGLE

BACKGROUND OF THE INVENTION

1. Field of the Invention

The present invention relates to gas combustor, especially to a gas combustor with function of adjusting combustion angle.

2. Description of Related Art

Fire is a must have element in our lives, with fire, we can cook food, can be provided with lighting, and the fire can also be used for combustion operations such as forging, soldering and welding. Take a canned gas for example, the canned gas can be utilized for refilling a lighter or connected to a connection ring of a portable stove, liquid gas is provided therein for lighting objects or cooking food, thereby bring conveniences to users; and the canned gas is easy to store and carry around so the gas combustor still plays an important role in our lives and cannot be easily replaced.

With the convenience provided by the canned gas, there are two types of gas combustors in the marketplace, U.S. Pat. No. 5,466,149 (corresponding to Taiwan Patent Registration No. 110192) and U.S. Pat. No. 5,564,919 (corresponding to Taiwan Patent Registration No. 112652) have disclosed a gas combustor, in which a gas discharge valve at the top end of a canned gas is pivoted with a filling nozzle at the bottom end of a heating torch, so liquid gas can be injected into a fuel storage tank, thereby enabling a gas discharge device disposed at the top end of in a fuel gas storage tank to be provided with gas and a flame device to be provided with fuel gas. Another type of gas combustor is illustrated as following: U.S. Pat. No. 5,735,684 (corresponding to Taiwan Patent Registration No. 134495) and U.S. Pat. No. 5,816,794 (corresponding to Taiwan Patent Registration No. 122521) have disclosed a gas combustor, in which a base is disposed at the bottom portion thereof as to be pivoted with a canned gas available in the commercial market, and after the fuel in the canned gas is gasified, the gas can be supplied to a combustion device disposed at an upper portion of the gas combustor, thereby being suitable to be applied in combustion operations, for example soldering, welding or others.

However, in the above-mention gas combustors, the angle defined by the flame device and the gas storage tank and the angle defined by the base and the combustion device are fixedly arranged, for example the flame device is arranged in 90 degrees relative to the gas storage tank, and the combustion device is arranged greater than 90 degrees, such as 125 degrees, relative to the base, so that a user can hold the gas storage tank or the base for performing a combustion operation.

Moreover, disadvantages of the above-mentioned gas combustors are provided as follows. When the gas combustor is desired to be operated in a small operation space, because the angle of the combustion device is fixedly arranged, if the length is not sufficient, the combustion device could not reach an object to be heated, and another gas combustor with a longer length has to be utilized for replacement, thus the user may need to prepare gas combustors with various angles for being suitable to be applied in different operation spaces.

Accordingly, if the gas combustor could be provided with a function of adjusting combustion angles, the combustion angle can be properly adjusted with respect to different operation spaces, so that the combustion operation can be facilitated, meanwhile unnecessary waste for buying gas combustors with different angles can be prevented; as such, the above-mentioned shortages and disadvantages shall be seriously concerned by the skilled people in the art.

SUMMARY OF THE INVENTION

One primary objective of the present invention is to provide a gas combustor with function of adjusting combustion angle, which has advantages of a combustion angle being capable of being properly adjusted with respect to different operation spaces, and saving unnecessary waste for buying gas combustors with different angles.

For achieving said objective, one technical solution provided by the present invention is to provide a gas combustor with function of adjusting combustion angle, which includes: a handgrip part, disposed with a gas discharge device having a gas discharge valve, a gas conveying soft pipe sleeved with the gas discharge valve, and a gas ejecting nozzle disposes at a downstream end of the gas conveying soft pipe; a fastening rack, disposed at a top end of the handgrip part, and having at least one positioning disk having an outer circumference annularly disposed with a plurality of positioning slots; and a flame device, having a support arm, wherein one end of the support arm has a pivotal part pivoted with the at least one positioning disk, and the pivotal part is correspondingly disposed with an elastic buckle mechanism capable of being buckled in each of the positioning at a location corresponding to the at least one positioning disk; the support arm has at least one air inlet hole communicated with a mixing chamber, wherein the gas ejecting nozzle is disposed at an upstream end of the mixing chamber and arranged to be adjacent to the at least one air inlet hole, a flame nozzle is disposed at a downstream end of the mixing chamber; with each of the elastic buckle mechanisms being displaced along the outer circumference of the corresponding at least one positioning disk, and being buckled in one of the positioning slots with respect to a desired inclined angle, the flame device is provided with a combustion angle adjusting effect relative to the handgrip part.

According to one embodiment of the present invention, the elastic buckle mechanism has a sleeve pipe having a bottom end thereof disposed with a block edge, a buckle tenon and an stretching spring are disposed in the sleeve pipe, and a locking unit is utilizing for being locked at a top end of the sleeve pipe, so that two ends of the stretching spring are respectively abutted against the locking unit and a flange of the buckle tenon, the block edge can be served as a blocking member for the flange of the buckle tenon, and an arc-shaped tenon head of the buckle tenon can be disposed outside the sleeve pipe, the tenon head can be displaced along the outer circumference of the corresponding at least one positioning disk, and buckled in one of the positioning slots according to a desired inclined angle.

According to one embodiment of the present invention, the handgrip part is a gas container utilized for storing liquid gas, and a bottom end of the gas container is provided with a gas filling nozzle.

According to one embodiment of the present invention, an insertion slot allowing an insertion part of the fastening rack to be inserted is formed in the gas container, and a top end of the insertion part is disposed with the at least one positioning disk having the outer circumference annularly formed with the plurality of positioning slots.

According to one embodiment of the present invention, the amount of the at least one positioning disk is two, and a recess allowing the pivotal part to be inserted and pivoted is formed between the two positioning disks.

According to one embodiment of the present invention, an accommodation slot allowing the piezoelectric device to be accommodated and positioned is formed below the at least one positioning disk of the fastening rack, and a free end of a conducive wire of the piezoelectric device is extended towards the flame nozzle of the flame device, and spaced with an interval relative to the flame nozzle.

According to one embodiment of the present invention, a connection part capable of being received in an outer pipe is disposed at a middle portion of the support arm, at least one air inlet hole is formed at the connection part, the conductive wire is allowed to pass the outer pipe, and the flame nozzle is enclosed by the outer pipe, so that a combustion flame is able to be ejected from an opening end of the outer pipe.

According to one embodiment of the present invention, an air adjusting ring is disposed at an outer side of the at least one air inlet hole, and the air adjusting ring is formed with at least one ventilation hole at a location corresponding to the at least one air inlet hole; by rotating the air adjusting ring, an aperture defined by the at least one ventilation hole shielding the at least one air inlet hole can be adjusted, so that the air amount entering the at least one air inlet hole can be determined.

According to one embodiment of the present invention, the flame nozzle is disposed in a heat insulation member made of a ceramic material, the heat insulation member is disposed in the outer pipe, one end of the heat insulation member is abutted against an inward-retracted edge formed at the opening end of the outer pipe, an elastic unit is disposed between another end of the heat insulation member and a convex ring of the support arm, so that the heat insulation member can be positioned in the opening end of the outer pipe, the conducive wire is allowed to pass the connection part, the outer pipe and the heat insulation member, and arranged to be near the flame nozzle.

According to one embodiment of the present invention, an rotary inner shell is disposed from the fastening rack to the connection part, the rotary inner shell is composed of an inner left shell and an inner right shell being engaged, thereby enabling the support arm and the elastic buckle mechanism between the connection part to the fastening rack to be enclosed, wherein a main shaft is laterally extended from the at least one positioning disk, a positioning shaft is located at a periphery of the main shaft; a pair of shaft holes allowing the main shaft to be pivoted is formed in the rotary inner shell at a location corresponding to the main shaft, and a pair of positioning slots allowing the positioning shaft to be inserted are formed at a location corresponding to the positioning shaft.

According to one embodiment of the present invention, a fastening case is further provided, the fastening case is composed of an outer left shell and an outer right shell being engaged, and at least one connection member is utilized for connecting the fastening case and the fastening rack, so that a front end and a top end of the fastening case is formed with an opening slot allowing the flame device and the rotary inner shell to be rotated therein; wherein, the gas discharge device further has a gas discharge pressing plate having one end disposed with the gas discharge valve; a location defined at a front lower side of the opening slot is disposed with a safety switch, a rear side of the safety switch is disposed with a pressing block capable of pressing the piezoelectric device, and a pressing plate for enabling the gas discharge pressing plate to generate a leverage effect.

According to one embodiment of the present invention, the safety switch further has a locking bolt capable of being left/right slid and capable of being abutted against a stop block of the fastening rack while being in a non-slid status, thereby forming a locking and non-pressing status; the locking bolt is linked with a left/right displacement of a sliding member disposed at a front side of the safety switch for allowing the locking bolt to be released from the stop block, thereby forming an unlocking and pressing status.

According to one embodiment of the present invention, the safety switch further has an auxiliary spring capable of being abutted against a stop wall of the fastening rack.

According to one embodiment of the present invention, the gas discharge valve further has a regulation unit, the regulation unit has a sleeve ring sleeved with the gas discharge valve, and a regulation rod laterally extended from the sleeve ring, and the regulation rod is able to be protruded from a case slot of the fastening case.

According to one embodiment of the present invention, the fastening case further has a continuous button, the continuous button is disposed in a button hole of the fastening case, and a recovery spring is disposed between the continuous button and the button hole, a buckle hook is extended from a rear end of the continuous button, and a buckle slot allowing the buckle hook to be buckled is formed in the safety switch at a location corresponding to the buckle hook; when the safety switch is in a pressed status, the continuous button is able to be pressed, so that the recovery spring is pressed, and the buckle slot and the buckle hook are in a buckled status, the safety switch is unable to return to an initial location, and the pressing plate is able to continuously press the gas discharge pressing plate for allowing the gas discharge valve to be kept in a gas supplying status.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
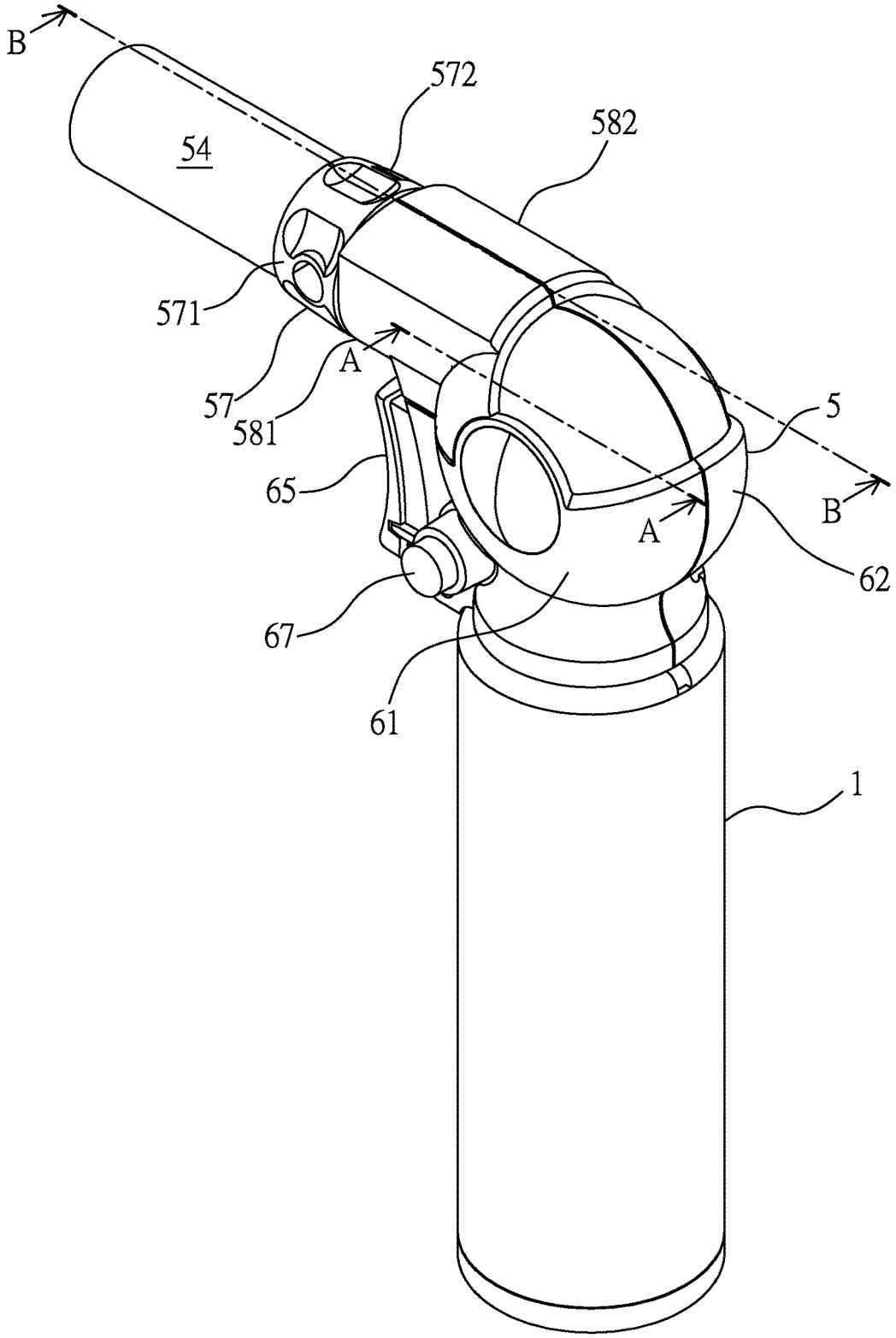
FIG. 1 is a perspective view illustrating a gas combustor with function of adjusting combustion angle according to the present invention.

Please refer from FIG. 1 to FIG. 5, the present invention provides a gas combustor, which includes a handgrip part 1, a gas discharge device 2, a fastening rack 3, a piezoelectric device 4, a flame device 5 and a fastening case 6.

The handgrip part 1 is utilized for being held by a hand of a user; according to one embodiment, the handgrip part 1 is a gas container. The gas container is utilized for storing liquid gas, a bottom end of the gas container is provided with a conventional gas filling nozzle (not shown in figures), so that the liquid gas (fuel gas) can be replenished. The gas discharge device 2 is disposed at a top end of the gas container.

The gas discharge device 2 is known as a prior art, and has a gas discharge valve 21 disposed at the top end of the gas container, a gas conveying soft pipe 22 having an upstream end thereof sleeved with the gas discharge valve 21, a gas ejecting nozzle 23 disposes at a downstream end of the gas conveying soft pipe 22, and a gas discharge pressing plate 24 having one end thereof engaged with the gas discharge valve 21. When another end of the gas discharge pressing plate 24 is pressed, a leverage effect is generated by the gas discharge pressing plate 24 for lifting the gas discharge valve 21, thereby forming an opened status, so that the gasified liquid gas stored in the handgrip part 1 is allowed to enter to gas conveying soft pipe 22 from the gas discharge valve 21 and rapidly ejected from the gas ejecting valve 23 so as to enter the flame device 5.

The gas discharge valve 2 further has a regulation unit 25. The regulation unit 25 has a sleeve ring 251 radially sleeved with the gas discharge valve 21, and a regulation rod 252 laterally extended from the sleeve ring 251. The regulation rod 252 is able to be protruded from the fastening case 6. As such, when the regulation rod 252 is pulled, the gas discharge valve 21 is able to be rotated with the sleeve ring 251, so that a gas discharge amount of the fuel gas can be regulated.

Figure 2:
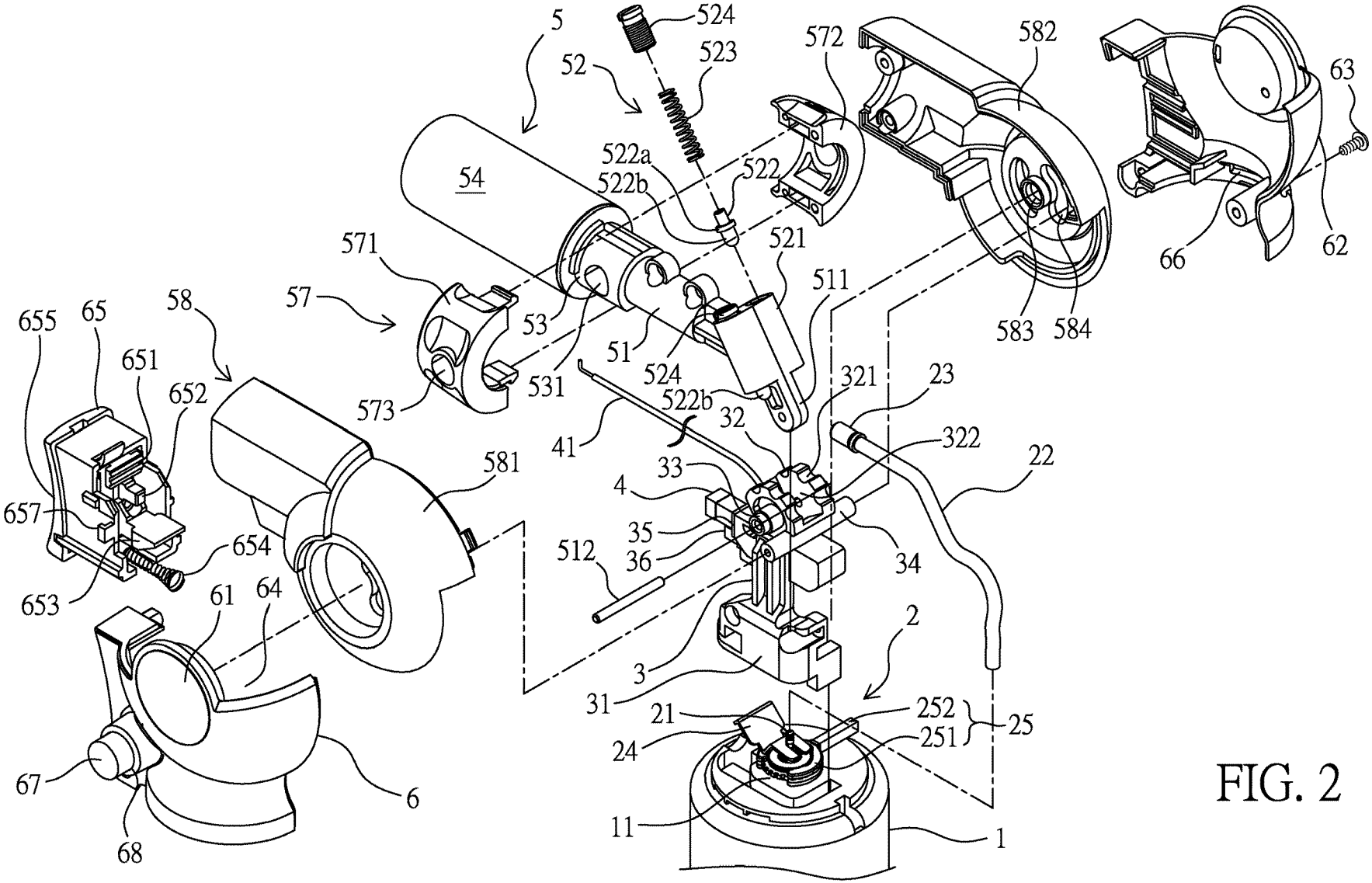
FIG. 2 is a perspective exploded view illustrating the gas combustor being disposed above the handgrip part according to the present invention.
Figure 3:
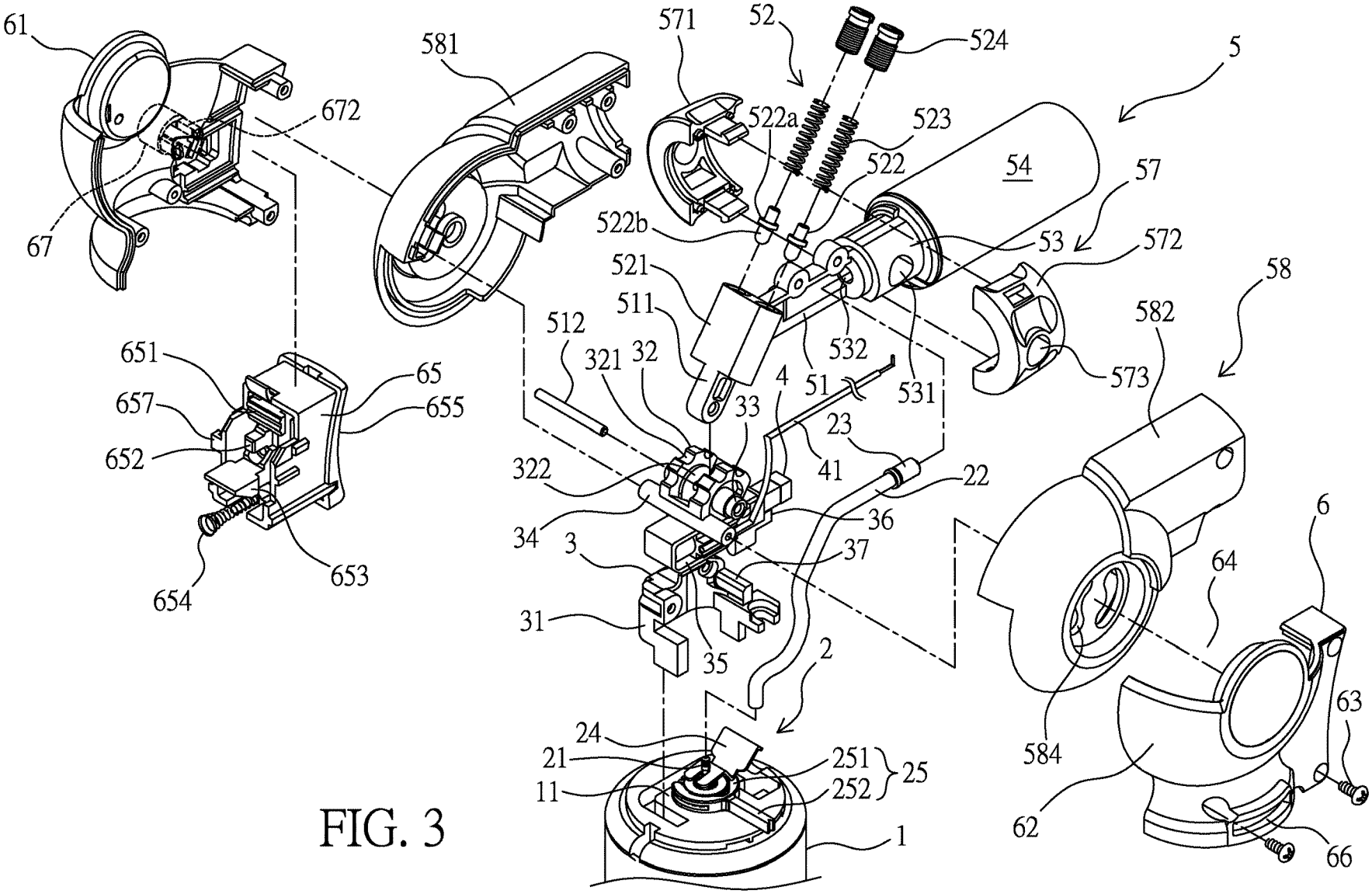
FIG. 3 is another perspective exploded view illustrating the gas combustor being disposed above the handgrip part according to the present invention.

An insertion part 31 inserted and fastened in an insertion slot 11 preformed in the gas container is provided at a bottom end of the fastening rack 3, a top end of the insertion part 31 is disposed with at least one positioning disk 32 having an outer circumference annularly formed with a plurality of positioning slots 321; as shown in FIG. 2 and FIG. 3, the amount of the at least one positioning disk 32 is preferably to be two, and a recess 322 is formed between the two positioning disks 32. Wherein, a main shaft 33 is laterally extended from the at least one positioning disk 32, a positioning shaft 34 is located at a periphery of the main shaft 33, the applications of the main shaft 33 and the positioning shaft 34 will be disclosed in the followings.

A accommodation slot 35 allowing the piezoelectric device 4 to be accommodated is formed below the at least one positioning disk 32 of the fastening rack 3, and a free end of a conducive wire 41 of the piezoelectric device 4 is extended into the flame device 5.

The flame device 5 has a support arm 51, one end of the support arm 51 is disposed with a pivotal part 511 pivoted with the at least one positioning disk 32; as shown in FIG. 2 and FIG. 3, the pivotal part 511 is inserted in the recess 322, and a shaft pin 512 is allowed to pass the at least one positioning disk 32, for example the main shaft 33 of the at least one positioning disk 32, and pivoted with the pivotal part 511. An elastic buckle mechanism 52 is disposed above the pivotal part 511, arranged at a location corresponding to each positioning disk 32 and capable of being buckled in each positioning slot 321.

Figure 4:
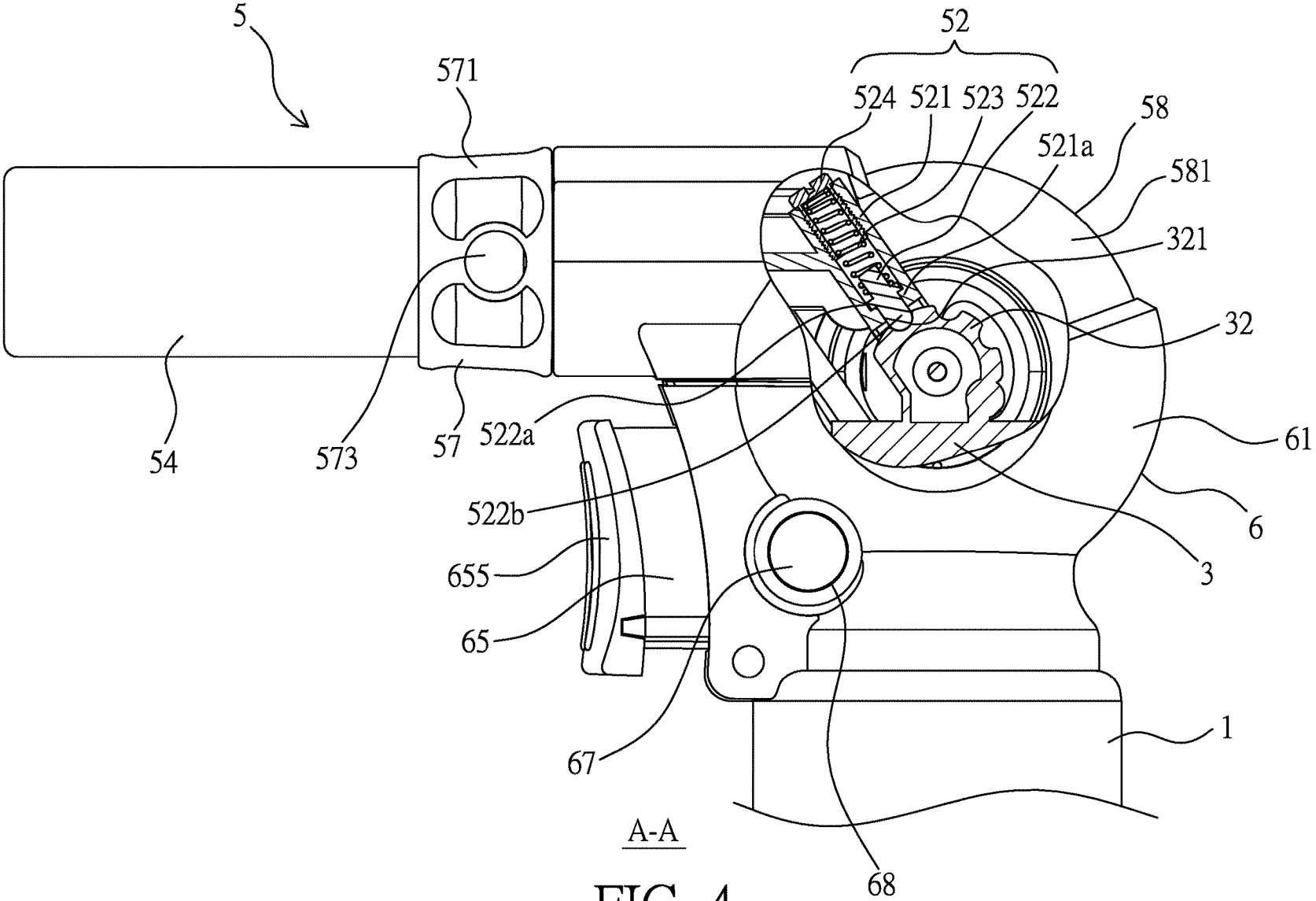
FIG. 4 is a partial cross sectional view of FIG. 1 taken alone an A-A line.

The elastic buckle mechanism 52 has a sleeve pipe 521 having a bottom end thereof disposed with a block edge 521*a* (as shown in FIG. 4), a buckle tenon 522 and an stretching spring 523 are sequentially disposed in the sleeve pipe 521, and a locking unit 524, for example a screw bolt, is utilizing for being locked at a top end of the sleeve pipe 521, so that two ends of the stretching spring 523 are respectively abutted against the locking unit 524 and a flange 522*a* of the buckle tenon 522, and the block edge 521*a* of the sleeve pipe 521 can be served as a blocking member for the flange 522*a* of the buckle tenon 522, and an arc-shaped tenon head 522*b* of the buckle tenon 522 can be disposed outside the sleeve pipe 521, the tenon head 522*b* can be displaced along the outer circumference of the corresponding positioning disk 32, and buckled in one of the positioning slots 321 according to a desired inclined angle, thus the flame device 5, for example the support arm 51, can be provided with a function of adjusting combustion angle relative to the handgrip part 1.

Figure 5:
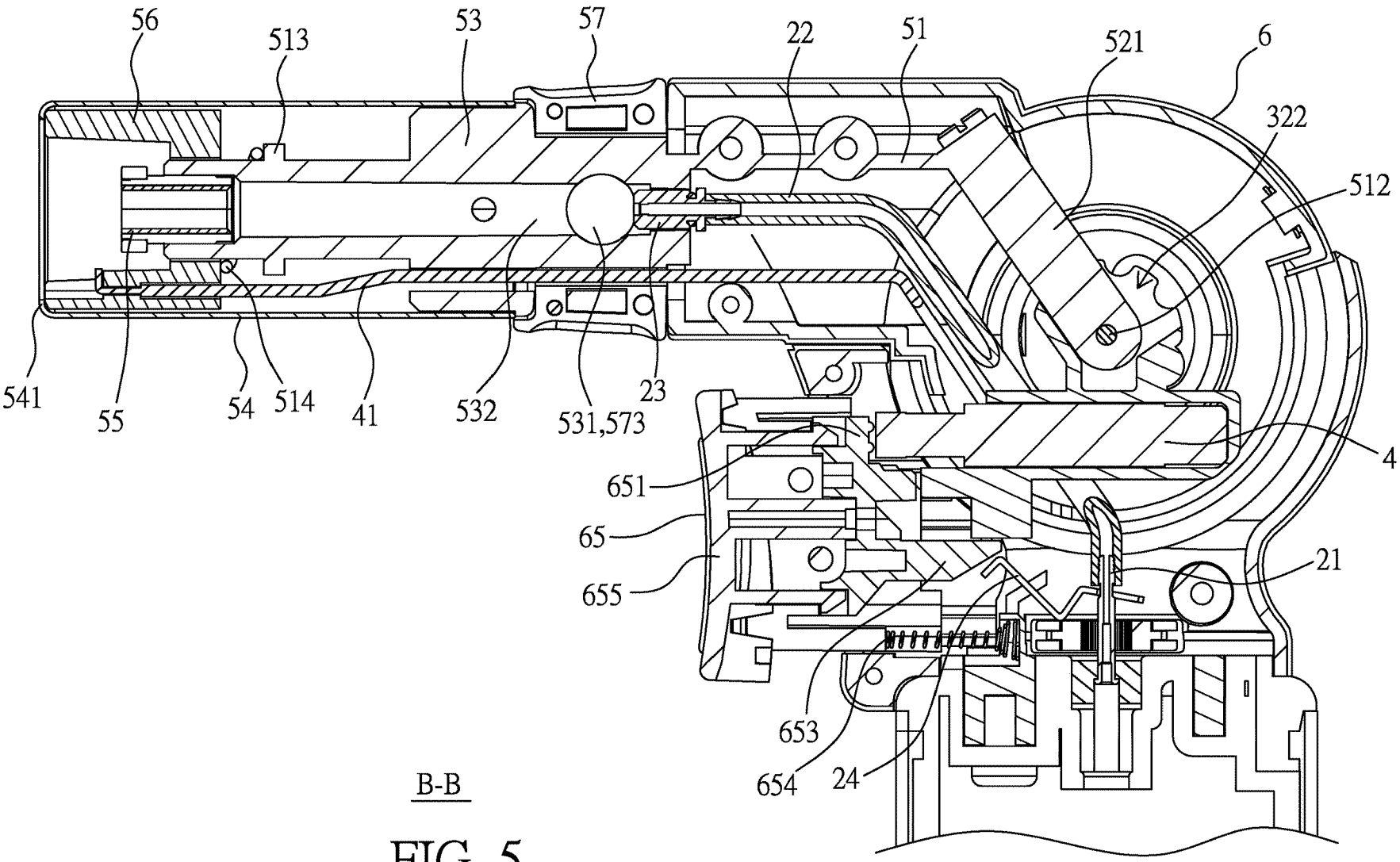
FIG. 5 is a partial cross sectional view of FIG. 1 taken alone a B-B line.

Please refer to FIG. 5, a connection part 53 capable of being received in an outer pipe 54 is disposed at a middle portion of the support arm 51, at least one air inlet hole 531 is formed at one side of the connection part 53, the at least one air inlet hole 531 is communicated with a mixing chamber 532 formed in the support arm 51, and the gas ejecting nozzle 23 is disposed at an upstream end of the mixing chamber 532 and arranged to be adjacent to the at least one air inlet hole 531; as such, an operation of the gas ejecting nozzle 23 ejecting the fuel gas can drive air to be introduced from the at least one air inlet hole 531, and the introduced air is allowed to enter the mixing chamber 532 for being mixed, thereby forming a mixed fuel gas. The mixed fuel gas is ejected from a flame nozzle 55 disposed at a downstream end of the mixing chamber 532, and the flame nozzle 55 is enclosed by the outer pipe 54, so that the combustion flame is able to be ejected from an opening end of the outer pipe 54.

Moreover, the flame nozzle 55 is disposed in a heat insulation member 56 made of a ceramic material, the heat insulation member 56 is disposed in the outer pipe 54, one end of the heat insulation member 56 is abutted against an inward-retracted edge 541 formed at the opening end of the outer pipe 54, an elastic unit 514, for example a spring, is disposed between another end of the heat insulation member 56 and a convex ring 513 of the support arm 51, so that the heat insulation member 56 can be positioned in the opening end of the outer pipe 54. The conducive wire 41 is allowed to pass the connection part 53 of the support arm 51, the outer pipe 54 and the heat insulation member 56, and an interval is formed between the free end of the conductive wire 41 and the flame nozzle 55, so that a static spark can be generated for igniting the mixed fuel gas ejected from the flame nozzle 55.

Moreover, an air adjusting ring 57 is disposed at an outer side of the at least one air inlet hole 531, the air adjusting ring 517 is composed of a half left ring 571 and a half right ring 572 being engaged, and at least one ventilation hole 573 is formed in the air adjusting ring 57. By rotating the air adjusting ring 57, an aperture defined by the at least one ventilation hole 573 shielding the at least one air inlet hole 531 can be adjusted, so that the air amount entering the at least one air inlet hole 531 can be determined so as to adjust the strength of the flame.

Furthermore, an rotary inner shell 58 is disposed between the fastening rack 3 and the connection part 53 of the support arm 51, the rotary inner shell 58 is composed of an inner left shell 581 and an inner right shell 582 being engaged, thereby enabling the support arm 51 and the elastic buckle mechanism 52 between the connection part 53 and the fastening rack 3 to be enclosed. A pair of shaft holes 583 allowing the main shaft 33 to be pivoted are formed in the rotary inner shell 58 at a location corresponding to the main shaft 33, and a pair of positioning slots 584 allowing the positioning shaft 34 to be inserted are formed at a location corresponding to the positioning shaft 34. When the positioning shaft 34 is abutted against two ends of the pair of positioning slots 584, the flame device 5 is formed with a rotating limitation, for example 90 or 180 degrees, relative to the fastening rack 3.

The fastening case 6 is composed of an outer left shell 61 and an outer right shell 62 being engaged, and at least one connection member 63, for example a screw, is utilized for passing the outer right shell 62 and the fastening rack 3 then being locked in the outer left shell 61, so that a front end and a top end of the fastening case 6 is formed with an opening slot 64 allowing the flame device 5 and the rotary inner shell 58 to be rotated therein. A location defined at a front lower side of the opening slot 64 is disposed with a safety switch 65, for example the safety switch disclosed in Taiwan Patent Application No. 105128535 (corresponding to China Patent Application No. 201710573119.1 and U.S. patent application Ser. No. 15/356,568), therefore the safety switch 65 is not provided with any further illustration. A rear side of the safety switch 65 is disposed with a pressing block 651 capable of pressing the piezoelectric device 4, a locking bolt 652 capable of being left/right slid and capable of being abutted against a stop block 36 preformed on the fastening rack 3 while being in a non-slid status, a pressing plate 653 for enabling the gas discharge pressing plate 24 to generate the leverage effect, and an auxiliary spring 654 capable of being abutted against of a stop wall 37 of the fastening rack 3. When the safety switch 65 is in a non-operated status, the locking bolt 652 is abutted against the stop block 36, thereby forming a locking and non-pressing status. The locking bolt 652 is linked with a left/right displacement of a sliding member 655 disposed at a front side of the safety switch 65 for allowing the locking bolt 652 to be released from the stop block 36, thereby forming an unlocking and pressing status.

As shown in FIG. 5, when the safety switch 65 is pressed by the finger of the user, the pressing block 651 can synchronously press the piezoelectric device 4, so that one end of the gas discharge pressing plate 24 is touched and pressed during the displacement of the pressing plate 653, and another end of the gas discharge pressing plate 24 is enabled to lift the gas discharge valve 21 for allowing the fuel gas to pass the gas conveying soft pipe 22 so as to be ejected from the gas ejecting nozzle 23 and enter the mixing chamber 532, and external air is introduced via the at least one ventilation hole 573 of the air adjusting ring 57 and the at least one air inlet hole 531 of the connection part 53 so as to enter the mixing chamber 532 for being mixed with the fuel gas, thereby forming the mixed fuel gas. Static electricity generated by the piezoelectric device 4 is allowed to pass the conductive wire 41, so that the static spark can be generated between the conductive wire 41 and the flame nozzle 55 at a location where the heat insulation member 56 is disposed, and the mixed fuel gas ejected from the flame nozzle 55 can be ignited for performing a combustion operation.

Figure 10:
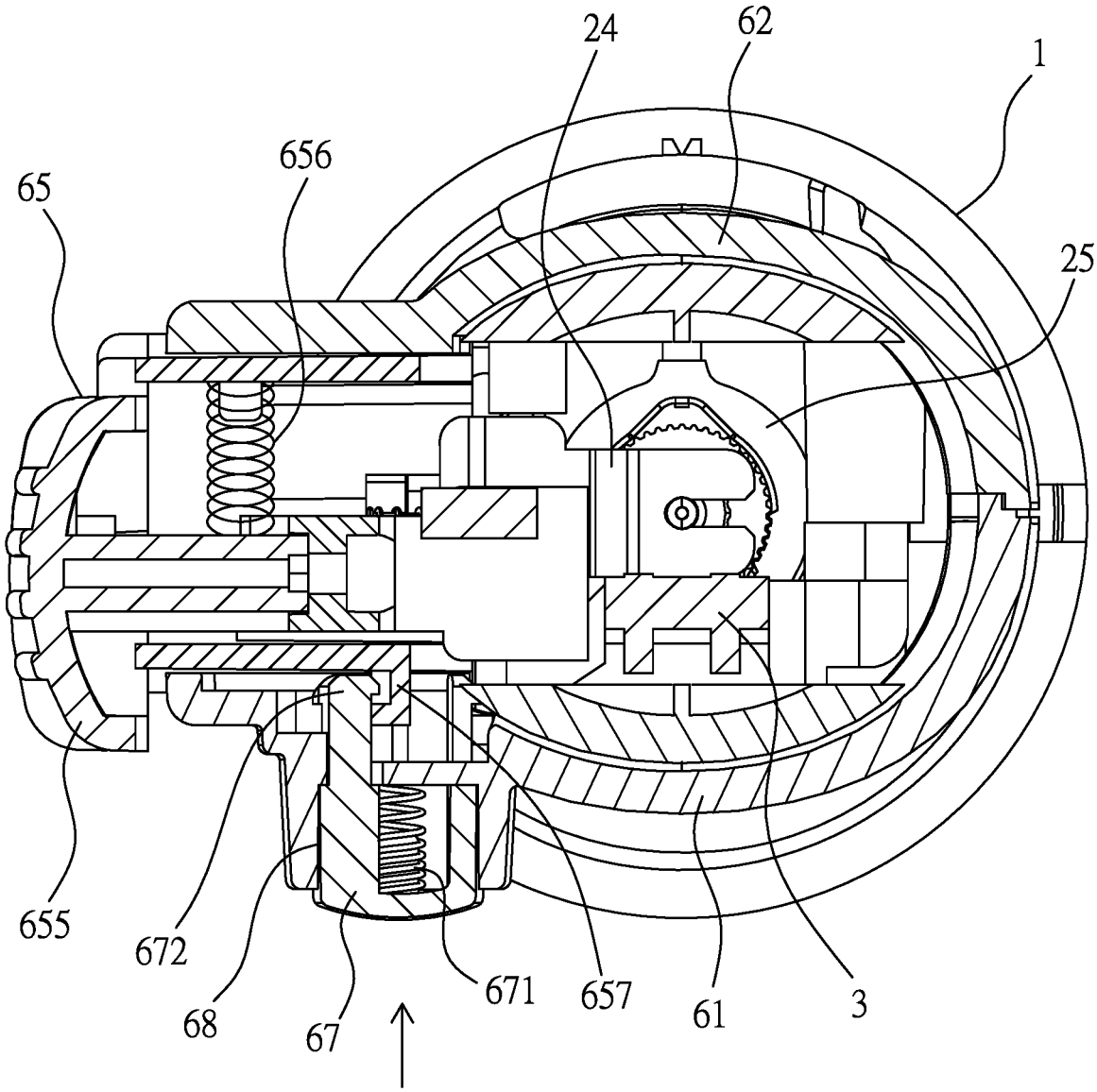
FIG. 10 is a cross sectional view illustrating the gas combustor being in a continuous combusting status according to the present invention.

When the safety switch 65 is no longer pressed by the finger of the user, the safety switch 65 is able to return to an initial non-operated position through the piezoelectric device 4 and an energy releasing effect provided by the auxiliary spring 654, and the sliding member 655 is able to return to an initial locked position though an energy releasing effect provided by an internal elastic unit 656 (as shown in FIG. 10), for example a spring, so that children can be protected from operating the gas combustor.

Moreover, the fastening case 6 is formed with a case slot 66 allowing the regulation rod 252 to be protruded at a location corresponding to the regulation rod 252, so that the air output amount of the gas discharge valve 21 can be regulated.

Please refer to FIG. 2, FIG. 3 and FIG. 10, the fastening case 6 further has a continuous button 67. The continuous button 67 is disposed in a button hole 68 of the fastening case 6, and a recovery spring 671 is disposed between the continuous button 67 and the button hole 68. A buckle hook 672 is extended from a rear end of the continuous button 67, and a buckle slot 657 allowing the buckle hook 672 to be buckled is formed in the safety switch 65 at a location corresponding to the buckle hook 672. When the safety switch 65 is in a pressed status, the continuous button 67 can be pressed by the user, the recovery spring 671 is pressed, and the safety switch 65 is no longer required to be pressed by the user, thus the buckle slot 657 and the buckle hook 672 are in a buckled status, and the safety switch 65 is unable to return to the initial position, and the pressing plate 653 is able to continuously press the gas discharge pressing plate 24 for allowing the gas discharge valve 21 to be kept in a gas supplying status, thus an inconvenience of the user being required to continuously press the safety switch 65 is avoided.

When the gas supplying status is desired to be terminated, the user only has to press the safety switch 65 again to allow the buckle hook 672 to be released from the buckle slot 657, meanwhile an energy releasing effect is provided by the recovery spring 671 for enabling the continuous button 67 to be recovered to the initial non-operated position.

As shown in FIG. 4, which shows an angle relation of the flame device 5 shown in FIG. 1 relative to the handgrip part 1, for example the flame device 5 is formed with a 90-degree angle relation relative to the handgrip part 1, it is clearly shown in FIG. 4 that the pair of buckle tenons 522 of the elastic buckle mechanism 52 are buckled in the pair of positioning slots 321 at a first location at the outer circumference of the pair of positioning disks 32, so that the flame device 5 is formed with a vertical combustion angle relative to the handgrip part 1.

Figure 6:
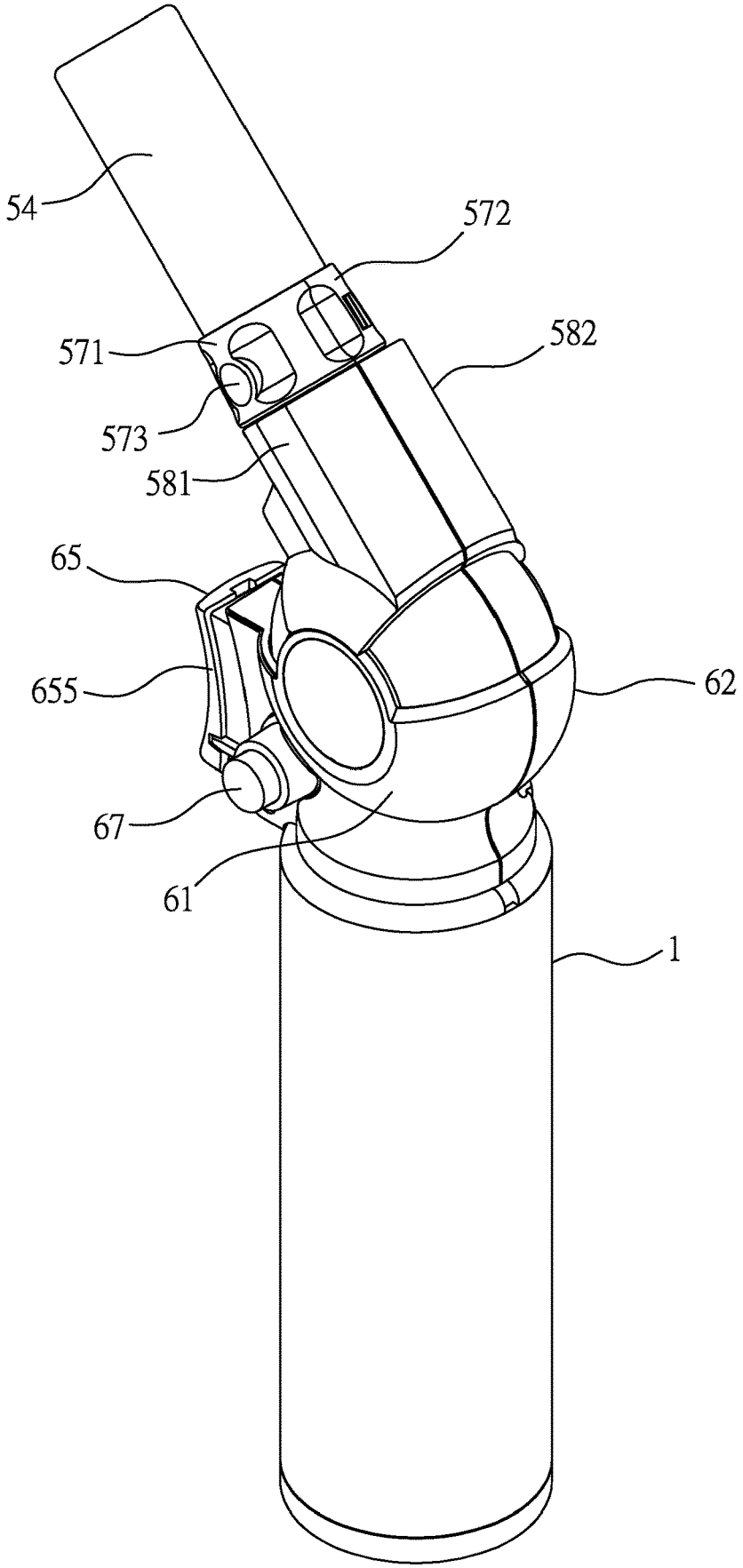
FIG. 6 is a perspective view illustrating the flame device of the gas combustor being adjusted to another angle according to the present invention.
Figure 7:
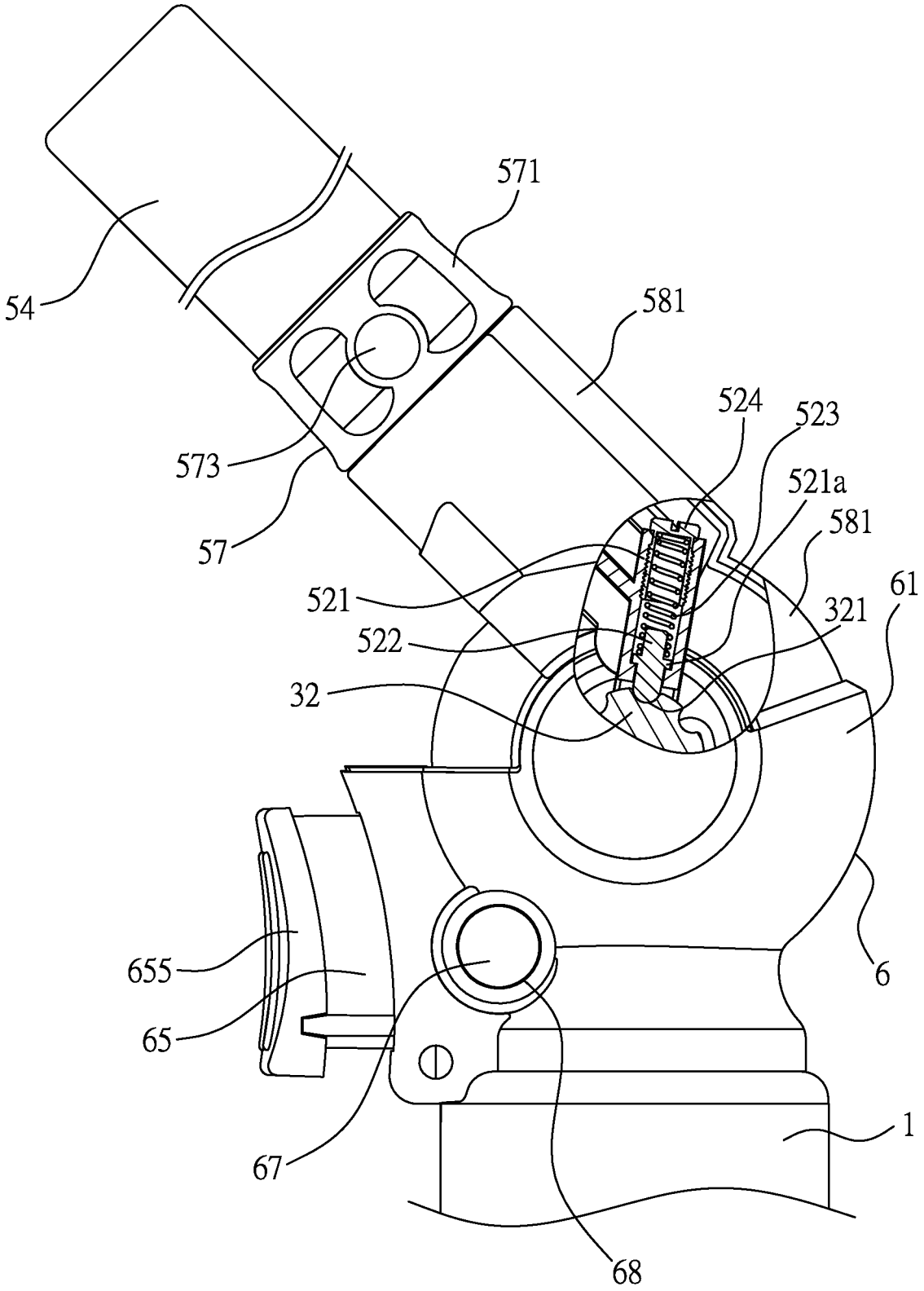
FIG. 7 is a partial cross sectional view illustrating the flame device of the gas combustor of FIG. 6 being positioned according to the present invention.

Please refer to FIG. 6 and FIG. 7, when the combustion angle is desired to be adjusted, the user only has to pull the flame device 5, so that the pair of buckle tenons 522 of the elastic buckle mechanism 52 are released from the first location, and displaced along the outer circumference of the pair of positioning disks 32 until being buckled in the pair of positioning slots 321 at a second location at the outer circumference, thus the flame device 5 is formed with an inclined combustion angle, for example 135 degrees, relative to the handgrip part 1.

Figure 8:
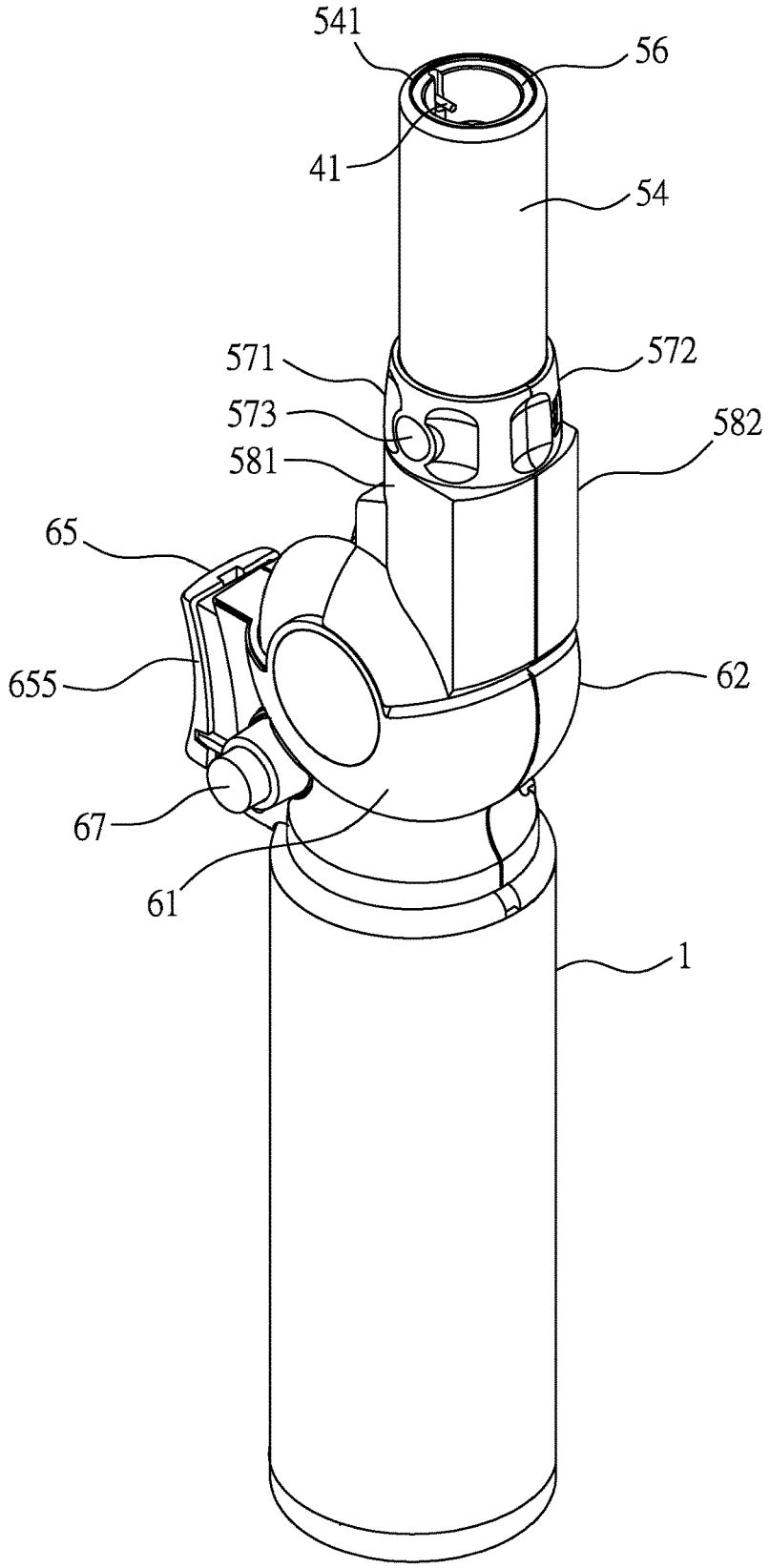
FIG. 8 is a perspective view illustrating the flame device of the gas combustor being adjusted to one another angle according to the present invention.
Figure 9:
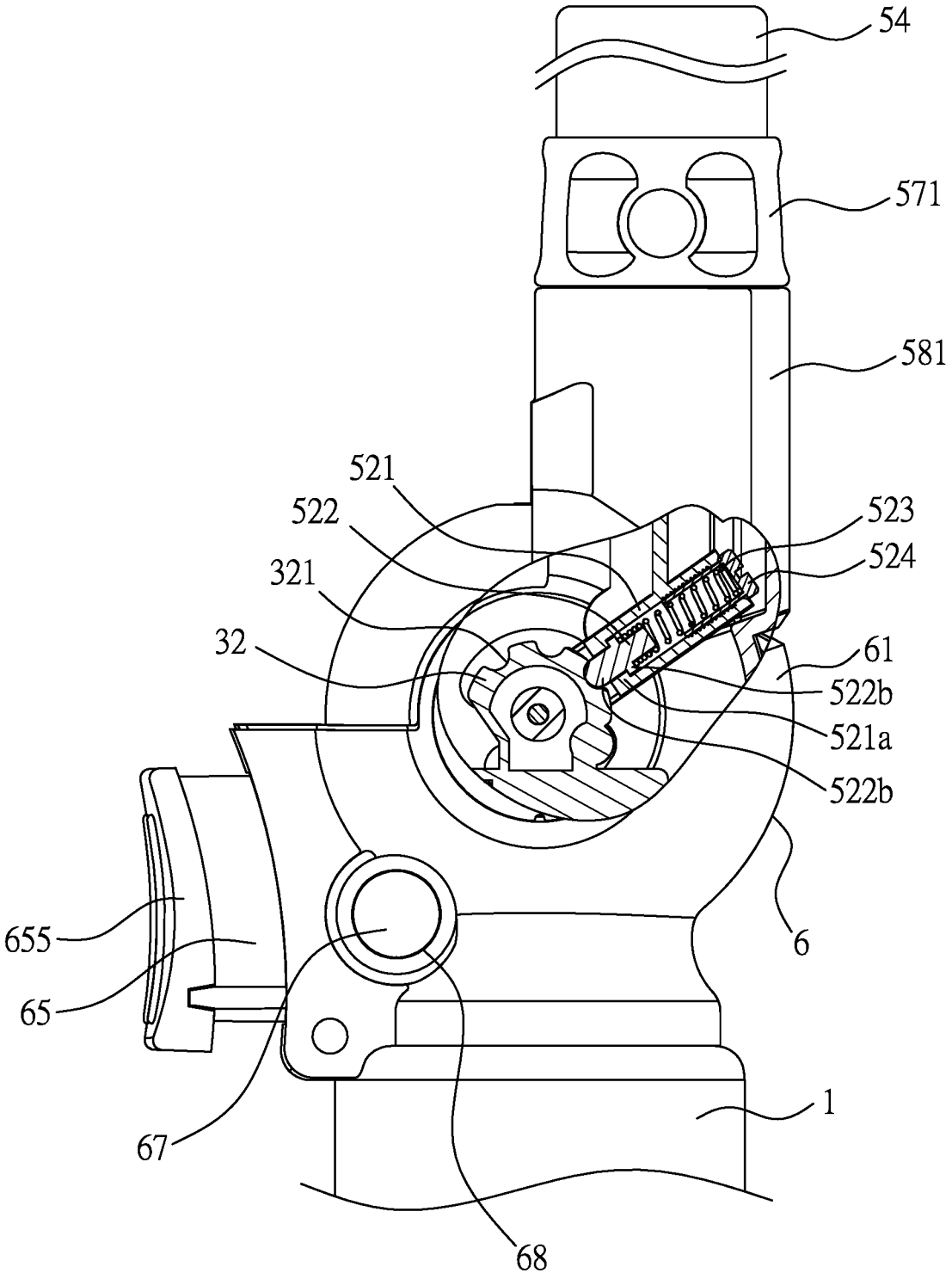
FIG. 9 is a partial cross sectional view illustrating the flame device of the gas combustor of FIG. 8 being positioned according to the present invention.

Please refer to FIG. 8 and FIG. 9, if the combustion angle at the second location is unable to satisfy the actual needs, the user can continue to pull the flame device 5, so that the pair of buckle tenons 522 of the elastic buckle mechanism 52 are released from the second location, and displaced along the outer circumference of the pair of positioning disks 32 until being buckled in the pair of positioning slots 321 at a third location at the outer circumference, thus the flame device 5 is formed with a linear combustion angle, for example 180 degrees, relative to the handgrip part 1.

Based on what has been disclosed above, advantages achieved by the present invention are as follows. The combustion angle can be properly adjusted with respect to different operation spaces, thus disadvantages of the conventional flame device being formed with a fixed combustion angle relative to the handgrip part and wasting money for buying gas combustion tools with various angles can be overcome. Accordingly, the gas combustor with function of adjusting combustion angle provided by the present invention in novel and more practical in use comparing to prior arts.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor with function of adjusting combustion angle, including:

a handgrip part, disposed with a gas discharge device having a gas discharge valve, a gas conveying soft pipe sleeved with said gas discharge valve, and a gas ejecting nozzle disposes at a downstream end of said gas conveying soft pipe;

a fastening rack, disposed at a top end of said handgrip part, and having at least one positioning disk having an outer circumference annularly disposed with a plurality of positioning slots; and a flame device, having a support arm, wherein one end of said support arm has a pivotal part pivoted with said at least one positioning disk, and said pivotal part is correspondingly disposed with an elastic buckle mechanism capable of being buckled in each of said plurality of positioning slots at a location corresponding to said at least one positioning disk; said support arm has at least one air inlet hole communicated with a mixing chamber, wherein said gas ejecting nozzle is disposed at an upstream end of said mixing chamber and arranged to be adjacent to said at least one air inlet hole, a flame nozzle is disposed at a downstream end of said mixing chamber;

with each said elastic buckle mechanism being displaced along said outer circumference of said corresponding at least one positioning disk, and being buckled in one of said plurality of positioning slots according to a desired inclined angle, said flame device is provided with a combustion angle adjusting effect relative to said handgrip part;

wherein there are two positioning disks, and a recess allowing said pivotal part to be inserted and pivoted is formed between said two positioning disks.

2. The gas combustor with function of adjusting combustion angle as claimed in claim 1, wherein said elastic buckle mechanism has a sleeve pipe having a bottom end thereof disposed with a block edge, a buckle tenon and an stretching spring are disposed in said sleeve pipe, and a locking unit is utilizing for being locked at a top end of said sleeve pipe, so that two ends of said stretching spring are respectively abutted against said locking unit and a flange of said buckle tenon, said block edge is able to be served as a blocking member for said flange of said buckle tenon, and an arc-shaped tenon head of said buckle tenon is able to be disposed outside said sleeve pipe, said tenon head is able to be displaced along said outer circumference of said corresponding at least one positioning disk, and buckled in one of said plurality of positioning slots according to said desired inclined angle.

3. The gas combustor with function of adjusting combustion angle as claimed in claim 1, wherein said handgrip part is a gas container utilized for storing liquid gas, and a bottom end of said gas container is provided with a gas filling nozzle.

4. The gas combustor with function of adjusting combustion angle as claimed in claim 3, wherein an insertion slot allowing an insertion part of said fastening rack to be inserted is formed in said gas container, and a top end of said insertion part is disposed with said at least one positioning disk having said outer circumference annularly formed with said plurality of positioning slots.

5. The gas combustor with function of adjusting combustion angle as claimed in claim 1, wherein an accommodation slot allowing said piezoelectric device to be accommodated and positioned is formed below said at least one positioning disk of said fastening rack, and a free end of a conducive wire of said piezoelectric device is extended towards said flame nozzle of said flame device, and spaced with an interval relative to said flame nozzle.

6. The gas combustor with function of adjusting combustion angle as claimed in claim 5, wherein a connection part capable of being received in an outer pipe is disposed at a middle portion of said support arm, at least one air inlet hole is formed at said connection part, said conductive wire is allowed to pass said outer pipe, and said flame nozzle is enclosed by said outer pipe, so that a combustion flame is able to be ejected from an opening end of said outer pipe.

7. The gas combustor with function of adjusting combustion angle as claimed in claim 6, wherein an air adjusting ring is disposed at an outer side of said at least one air inlet hole, and said air adjusting ring is formed with at least one ventilation hole at a location corresponding to said at least one air inlet hole; by rotating said air adjusting ring, an aperture defined by said at least one ventilation hole shielding said at least one air inlet hole is able to be adjusted, so that air amount entering said at least one air inlet hole is able to be determined.

8. The gas combustor with function of adjusting combustion angle as claimed in claim 6, wherein said flame nozzle is disposed in a heat insulation member made of a ceramic material, said heat insulation member is disposed in said outer pipe, one end of said heat insulation member is abutted against an inward-retracted edge formed at said opening end of said outer pipe, an elastic unit is disposed between another end of said heat insulation member and a convex ring of said support arm, so that said heat insulation member is able to be positioned in said opening end of said outer pipe, said conducive wire is allowed to pass said connection part, said outer pipe and said heat insulation member, and arranged to be near said flame nozzle.

9. The gas combustor with function of adjusting combustion angle as claimed in claim 6, wherein an rotary inner shell is disposed between said fastening rack and said connection part, said rotary inner shell is composed of an inner left shell and an inner right shell being engaged, thereby enabling said support arm and said elastic buckle mechanism between said connection part and said fastening rack to be enclosed, wherein a main shaft is laterally extended from said at least one positioning disk, a positioning shaft is located at a periphery of said main shaft; a pair of shaft holes allowing said main shaft to be pivoted is formed in said rotary inner shell at a location corresponding to said main shaft, and a pair of positioning slots allowing said positioning shaft to be inserted are formed at a location corresponding to said positioning shaft.

10. The gas combustor with function of adjusting combustion angle as claimed in claim 9, further including a fastening case, said fastening case is composed of an outer left shell and an outer right shell being engaged, and at least one connection member is utilized for connecting said fastening case and said fastening rack, so that a front end and a top end of said fastening case is formed with an opening slot allowing said flame device and said rotary inner shell to be rotated therein; wherein, said gas discharge device further has a gas discharge pressing plate having one end engaged with said gas discharge valve; a location defined at a front lower side of said opening slot is disposed with a safety switch, a rear side of said safety switch is disposed with a pressing block capable of pressing said piezoelectric device, and a pressing plate for enabling said gas discharge pressing plate to generate a leverage effect.

11. The gas combustor with function of adjusting combustion angle as claimed in claim 10, wherein said safety switch further has a locking bolt capable of being left/right slid and capable of being abutted against a stop block of said fastening rack while being in a non-slid status, thereby forming a locking and non-pressing status; said locking bolt is linked with a left/right displacement of a sliding member disposed at a front side of said safety switch for allowing said locking bolt to be released from said stop block, thereby forming an unlocking and pressing status.

12. The gas combustor with function of adjusting combustion angle as claimed in claim 10, wherein said safety switch further has an auxiliary spring capable of being abutted against a stop wall of said fastening rack.

13. The gas combustor with function of adjusting combustion angle as claimed in claim 10, wherein said gas discharge valve further has a regulation unit, said regulation unit has a sleeve ring sleeved with said gas discharge valve, and a regulation rod laterally extended from said sleeve ring, and said regulation rod is able to be protruded from a case slot of said fastening case.

14. The gas combustor with function of adjusting combustion angle as claimed in claim 10, wherein said fastening case further has a continuous button, said continuous button is disposed in a button hole of said fastening case, and a recovery spring is disposed between said continuous button and said button hole, a buckle hook is extended from a rear end of said continuous button, and a buckle slot allowing said buckle hook to be buckled is formed in said safety switch at a location corresponding to said buckle hook; when said safety switch is in a pressed status, said continuous button is able to be pressed, so that said recovery spring is pressed, and said buckle slot and said buckle hook are in a buckled status, said safety switch is unable to return to an initial location, and said pressing plate is able to continuously press said gas discharge pressing plate for allowing said gas discharge valve to be kept in a gas supplying status.

* * * * *